US011618061B2

(12) United States Patent
Campos Hernandez

(10) Patent No.: US 11,618,061 B2
(45) Date of Patent: Apr. 4, 2023

(54) DEVICE FOR CLEANING, DISINFECTING AND UNBLOCKING DRAINS OF KITCHEN AND BATHROOM SINKS, WASTE DISPOSAL UNITS AND OTHER USES

(71) Applicants: Cinteria Hispano Italo-Americana S.A., Cabrianes (ES); Fernando Campos Hernandez, Cabrianes (ES)

(72) Inventor: Fernando Campos Hernandez, Cabrianes (ES)

(73) Assignees: Cinteria Hispano Italo-American S.A., Cabrianes (ES); Fernando Campos Hernandez, Cabrianes (ES)

( * ) Notice: Subject to any disclaimer, the term of this patent is extended or adjusted under 35 U.S.C. 154(b) by 77 days.

(21) Appl. No.: 17/042,437

(22) PCT Filed: Mar. 26, 2019

(86) PCT No.: PCT/ES2019/070198
§ 371 (c)(1),
(2) Date: Oct. 30, 2020

(87) PCT Pub. No.: WO2019/185962
PCT Pub. Date: Oct. 3, 2019

(65) Prior Publication Data

US 2021/0078054 A1 Mar. 18, 2021

(30) Foreign Application Priority Data

Mar. 27, 2018 (ES) ..... ES201830421U

(51) Int. Cl.
*B08B 9/032* (2006.01)
*B05B 13/06* (2006.01)
(Continued)

(52) U.S. Cl.
CPC ..... *B08B 9/0321* (2013.01); *B05B 13/0627* (2013.01); *B08B 9/02* (2013.01); *E03C 1/306* (2013.01)

(58) Field of Classification Search
CPC ..... E03C 1/306; E03C 1/086; B05B 13/06; B05B 13/0627; B08B 9/02; E03D 9/00
See application file for complete search history.

(56) References Cited

U.S. PATENT DOCUMENTS 1,925,359 A 9/1933 Alonso
2,050,365 A * 8/1936 Moss ..... E03C 1/306 4/255.09
(Continued)

FOREIGN PATENT DOCUMENTS

DE 8906138 U1 7/1989
EP 2002901 A2 12/2008
(Continued)

OTHER PUBLICATIONS

Int'l. Search Report for PCT/ES2019/070198, dated Jun. 17, 2019.
Extended search report issued in corresponding European Patent Appln. No. 19776715.5, dated May 18, 2021.

*Primary Examiner* — Benjamin L Osterhout
(74) *Attorney, Agent, or Firm* — MaxGoLaw PLLC

(57) ABSTRACT

A device is provided to clean, disinfect, and unclog a plumbing outlet. The device includes a cylindrical body (2) defining a fluid conduit between a first end configured to fit to a tap of pressurized fluid outlet (3). The cylindrical body has a diameter reducer (21) that narrows in diameter from the first end to a second end and forms an internal housing (22). The diameter reducer (22) induces a Venturi effect in water passing therethrough from the tap of pressurized fluid outlet (3). The device further includes a tube in fluid communication with the second end, a dome receiving an end of the tube and configured to surround the plumbing
(Continued)

outlet and through which the water passes to clean, disinfect and unclog the plumbing outlet. A bar (5) of detergent or another chemical operative to clean, disinfect or unclog is configured to reside in the internal housing (22).

18 Claims, 1 Drawing Sheet

(51) Int. Cl.
*E03C 1/306* (2006.01)
*B08B 9/02* (2006.01)

(56) References Cited

U.S. PATENT DOCUMENTS 2,273,984 A * 2/1942 Osborn ..... E03F 9/00 134/167 C
2,315,673 A 4/1943 Taylor
3,513,025 A * 5/1970 Gutrich ..... E03C 1/306 4/DIG. 9
3,937,404 A * 2/1976 Johnson ..... B08B 9/0322 4/255.09
4,238,860 A * 12/1980 Dixon ..... E03C 1/306 4/255.09
4,447,917 A * 5/1984 Walter ..... E03C 1/306 239/602
4,756,480 A * 7/1988 Fish ..... E03C 1/306 4/255.09
5,249,311 A * 10/1993 Rau ..... E03C 1/306 4/255.05
5,497,514 A 3/1996 Miller
5,682,620 A * 11/1997 Stoltz ..... B08B 9/045 15/104.33
5,941,273 A * 8/1999 Petrovich ..... E03C 1/292 137/247.35
6,206,980 B1 * 3/2001 Robinson ..... A47L 11/4088 15/322
6,775,857 B2 * 8/2004 Hughes, Jr. ..... E03C 1/306 4/255.08
9,051,721 B2 6/2015 Paulsen et al.
9,322,154 B2 * 4/2016 Beaumont ..... E03C 1/306
9,359,751 B2 6/2016 Beaumont
9,708,804 B2 * 7/2017 Palmer, II ..... E03C 1/306
2003/0028956 A1 * 2/2003 Pangramuyen ..... E03C 1/304 4/255.01
2005/0050624 A1 * 3/2005 Pangramuyen ..... E03C 1/308 4/255.01
2008/0022487 A1 * 1/2008 Young ..... A47L 7/0009 15/414
2008/0276392 A1 * 11/2008 Schultz ..... E03C 1/126 15/104.33
2010/0132101 A1 * 6/2010 Bates ..... E03C 1/304 4/255.04
2011/0056007 A1 * 3/2011 Caywood ..... E03F 9/002 4/255.11
2011/0219526 A1 * 9/2011 Keegan ..... E03C 1/308 4/255.12
2016/0325242 A1 11/2016 Stevens

FOREIGN PATENT DOCUMENTS

ES 1025683 U 1/1994
ES 2584067 T3 9/2016
FR 832906 A 10/1938
GB 543303 A 2/1942
GB 2452865 A 3/2009
KR 20160042806 A 4/2016

* cited by examiner

DEVICE FOR CLEANING, DISINFECTING AND UNBLOCKING DRAINS OF KITCHEN AND BATHROOM SINKS, WASTE DISPOSAL UNITS AND OTHER USES

OBJECT OF THE INVENTION

The invention, as stated in the title of this specification, refers to a device for cleaning, disinfecting and unblocking drains of kitchen and bathroom sinks, waste disposal units and other uses providing the function to which it is designed with advantages and characteristics, that are disclosed in detail thereafter and which means a significant novelty in the current state-of-the-art.

The object of this invention is a device that is fixed at the outlet of the standard tap of the kitchen sink, that of the washbasin, that of the bathtub or that of the bathroom bidet, of the tap of the laundry sink or of the sink tap of any other use and that, essentially, comprises a diameter reducer that, thanks to the Venturi effect, increases the water exit pressure through a flexible pipe connected next and at the distal end of which the pressurized water can be applied to clean the sink and to clean or unclog even within the drain and the rest of the hardly accessible areas of the sink, for example the overflow duct, where the dirt is incrusted that, in turn, generates bad smells, with the advantage that, although optionally the use of chemicals, can be added, in principles this cleaning and unclogging can be achieved with only the water pressure, which is cheaper and avoid harming the environment. All these applications of the invention are possible without having to dismount any part of the sink or any drain or garbage disposal.

FIELD OF APPLICATION OF THE INVENTION

The field of application of this invention is within the sector of the industry engaged in manufacturing cleaning apparatuses and devices, mainly focusing in the scope of those designed to clean and disinfect kitchens and bathrooms, as well within the domestic as the professional scope, encompassing at the same time the scope of the devices and systems to unclog drains.

BACKGROUND OF THE INVENTION

As reference to the current state-of-the-art, it shall be stated that, although multiple products and means are known for cleaning kitchen and bathroom sinks as well as different products or mechanical means to clean and unclog them, at least this applicant is not aware of the existence of any device capable to achieve both things at the same time, that means cleaning and unclogging, as it occurs with the device claimed herein, as well as of any other invention having a similar application possessing technical and structural characteristics equal or similar to those that the said device possesses, thanks to which, cleaning and unclogging drains can be even carried out only with water.

EXPLANATION OF THE INVENTION

The device for cleaning, disinfecting and unblocking drains of kitchen and bathroom sinks, waste disposal units and other uses that the invention proposes, is therefore configured as a significant novelty within its field of application, the characterizing details that distinguish it duly appearing in the final claims attached to this description.

Concretely, what this invention proposes, as it was said above, is a device designed to be fixed, in an easily removable manner, at the outlet of the standard tap of a sanitary sink, for example the kitchen sink, the washbasin sink, the bathtub sink of that of the bathroom bidet, the laundry sink or any other sink it is sought to be cleaned, as well at its surface as its drain, for which it comprises a diameter reducer that, thanks to the Venturi effect, increases the water exit pressure and, through a flexible pipe that it comprises connected next to the said diameter reducer, allows to apply the pressurized water on the surface of the sink to clean it but also in the areas having hardly accessible dirt, such as within the drain or the overflow duct, in which the dirt is encrusted which, in turn, generate bad smells.

Preferably, the final length of this pipe is narrower and of a semi-rigid material to penetrate through the drain or overflow holes and fit itself to the pipe elbows.

Anyways, optionally, the distal end of the pipe can be blind and incorporate a series of side holes in order to radially distribute the pressurized water and thus clean the internal part of the drain duct.

Optionally, the final end of the pipe can have a round or rectangular section in order to be able to be inserted through the grooves of the overflow that are usually elongated (not round).

Preferably, the pipe possesses a dismountable final length in order it can be interchanged and, having different models available, round, square, with side holes or without them, to be able to place it where it is best fit in each case.

According to an option of embodiment, the body of the device in which the diameter reducer is located defines an internal housing adapted to incorporate a detergent bar or another cleaning chemical, disinfectant and/or perfuming agent. In this case, this device not only cleans but it can also disinfect.

This bar, preferably, possesses one or more holes that cross it in order that the water does not remain blocked by its presence but flows through it and is being diluting the product of which it is made poured in the water.

In addition, the body of the device that comprises the reducer also incorporate an aerator filter in order that the said reducer device can replace the aerator usually installed at the outlet of the taps to reduce the flow, having to mention that in the preferred embodiment, the said body of the device is cylindrical and is configured to be fixed screwed on the thread of the outlet of the tap with which the standard taps use to be provided with, precisely, for incorporating the said aerator.

Thus, the reducer device can be dismounted simply the part of the aerator remaining in a dismounted position.

Last, it shall be mentioned that, in order that the water, that is coming out under pressure by the end of the pipe, does not splash out, especially when it is applied within the drain, it was provided that the device also comprises a protection such as a dome, preferably transparent, with a hole through which the pipe is inserted, in such a manner that, if splashes are generated, they are interrupted by the protection.

The device disclosed to clean, disinfect and unclog kitchen, bathroom sinks drains, garbage disposal and other uses, consists, therefore, in an innovating structure having characteristics unknown up to now for the object to which it is designed, reasons that, jointly with its practical utility, provide it with sufficient ground to obtain the privilege of exclusivity that is applied for.

DESCRIPTION OF THE DRAWINGS

To complement the description that is being carried out, and in order to assist to a best understanding of the characteristics of the invention, attached to this specification, as an integral part thereof, there is a drawing in which, with illustrative and no limiting nature, the following has been represented.

PREFERRED EMBODIMENT OF THE INVENTION

Figure 1:
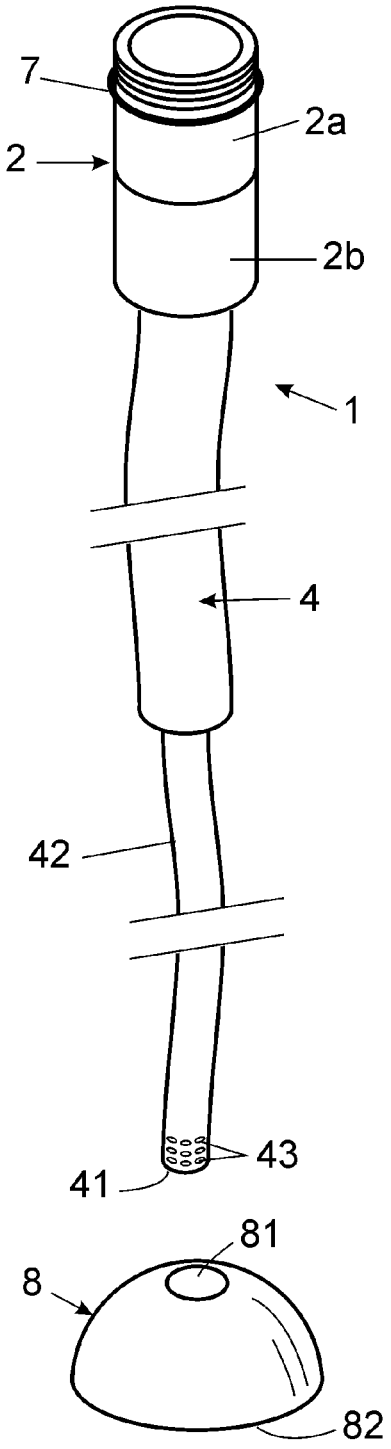
FIG. 1.—It shows a schematic view in perspective of an example of embodiment of the device to clean, disinfect and unclog kitchen, bathroom sinks drains, garbage disposals or other uses, object of the invention, the main parts and elements it comprises can be seen as well as their arrangement and configuration.

At the light of these figures, and according to the numerals adopted, a non-limiting example of embodiment of the device to clean, disinfect and unclog kitchen, bathroom sinks drains, garbage disposals and other uses of the invention, which comprises the parts and elements indicated and disclosed in detail thereafter.

Thus, as it can be seen in the said figures, the device (1) of the invention is essentially constituted by a cylindrical body (2) that, open at its two ends and provided with means for its tight fitting to the outlet (3) of a tap, comprises a reducer length (21), of the diameter of the said outlet that provokes a Venturi effect in the water that is passing through it when opening the tap, the said body (2) being connected, in turn, to a flexible pipe (4), also open at its ends, so that, by its distal end (41), the water is expelled under pressure and can be oriented to carry out cleaning the sink where the tap is located in the non-accessible areas such as the overflow or the drain.

Preferably, the pipe (4) offers a final length (42) even narrower and of a semi-rigid material.

Optionally, the distal end (41) of the pipe (4), whether it possesses or not such final length (42), is blind but incorporates several side holes (43) that radially distribute the pressurized water.

Optionally, the final length (42) of the pipe (4) has a round section or a rectangular section, in order that it can be inserted through round holes or elongated grooves of the overflow.

Preferably, the final length (42) is of a dismountable and interchangeable nature.

Figure 2:
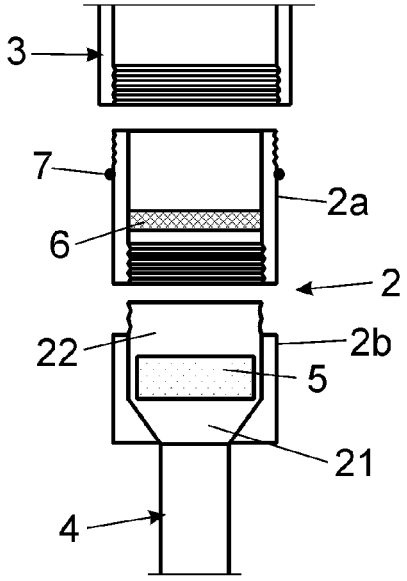
FIG. 2.—It shows a section schematic view of the device main body that is screwed on the tap and that comprises the diameter reducer, its configurations and other eventual elements can be seen.

As for the FIG. 2, it can be seen how, in the preferred embodiment, the body (2) of the device (1), that comprises the diameter reducer (21) defines an internal housing (22) adapted to incorporate a bar (5) of detergent or another chemical.

Figure 3:
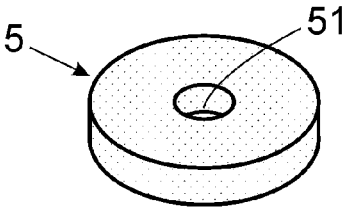
FIGS. 3 and 4.—They show respective views in perspective of two possible examples of the bar that, the device body optionally incorporates.
Figure 4:
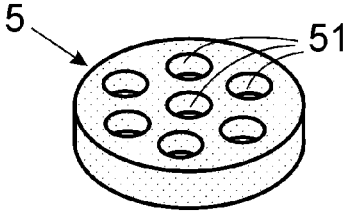

The bar (5), as shown in the FIGS. 3 and 4, possesses one or more through holes (51) that allow the passage of the water through them.

In the said FIG. 2, in addition, it can be seen how, in the said preferred embodiment, the body (2) also incorporates an aerator filter (6).

More concretely, the said preferred embodiment of the device (1) comprises a cylindrical body (2) and is configured to be fixed by screwing it on the outlet thread (3) of the standard tap, and it shows two independent parts, also couplable to each other by means of a thread, one upper (2*a*) with the aerator filter (6), that can be left permanently stationary at the outlet of the tap (3), and a lower (2*b*) with the diameter reducer (21), and the internal housing (22) for the bar (5), and in which the pipe (4) is coupled, that can be mounted and dismounted, at the moment of cleaning or unclogging, by screwing it on the upper part (2*a*).

Preferably, the coupling of the body (2) with the outlet (3) of the tap (3), in addition, comprises a sealing O-ring (7).

Last, the preferred embodiment of the device (1) in addition possesses a protection such as a dome (8), preferably transparent, with an upper hole (81) adapted to insert the pipe (4) through it and a lower opening (82) having a larger diameter, preferably equal or larger than that of the drain outlet, so that, splashes generated by the pressured water exit through the distal end (41) of the said pipe (4) when cleaning or unclogging are stopped by the said protection (8).

The nature of this invention having been sufficiently disclosed, as well as the manner to implement it, it is not deemed necessary to extend its explanation any longer in order that any man skilled in the art comprises its extent and the advantages arising from it, and it is stated that within its essence, it can be implemented in other embodiments that differ in detail of that indicated for example purpose, and to which shall also apply the protection that is sought, provided that its main principle is not altered, changed or modified.

The invention claimed is:

1. A device to clean, disinfect, and unclog a plumbing outlet comprising:

a cylindrical body (2) defining a fluid conduit between a first end configured to fit to a tap of pressurized fluid outlet (3), the cylindrical body having a diameter reducer (21) that narrows in diameter from the first end to a second end and forms an internal housing (22), the diameter reducer (21) configured to induce a Venturi effect in water passing therethrough from the tap of pressurized fluid outlet (3);

a pipe (4) in fluid communication with the second end;

a dome receiving an end of the pipe (4) and configured to surround the plumbing outlet and through which the water passes to clean, disinfect, and unclog the plumbing outlet.

2. The device according to claim 1, wherein the end of the pipe (4) has a round cross-section.

3. The device according to claim 1, wherein the end of the pipe (4) has a rectangular cross-section.

4. The device according to claim 1, wherein the end (41) of the pipe (4) is blind but incorporates radial side holes (43).

5. The device according to claim 1, wherein the cylindrical body (2) incorporates an aerator filter (6).

6. The device according to claim 1, wherein the cylindrical body (2) has threads configured to be fixed to threads on the tap of pressurized fluid outlet (3) and comprises two independent parts, also couplable to each other by means of a thread, one upper (2*a*) with an aerator filter (6), that can be left permanently fixed at the outlet of the tap (3), and a lower (2*b*) with the diameter reducer (21).

7. The device according to claim 1, wherein the cylindrical body (2) is coupled with the outlet (3) of the tap of the outlet (3) with a sealing O-ring (7).

8. The device according to claim 1, wherein the dome has an upper hole (81) configured to receive the pipe (4) therethrough.

9. The device according to the claim 8, wherein the dome is transparent.

10. A device to clean, disinfect, and unclog a plumbing outlet comprising:

a cylindrical body (2) defining a fluid conduit between a first end configured to fit to a tap of pressurized fluid outlet (3), the cylindrical body having a diameter reducer (21) that narrows in diameter from the first end to a second end and forms an internal housing (22), the diameter reducer (22) configured to induce a Venturi effect in water passing therethrough from the tap of pressurized fluid outlet (3);

a bar (5) of detergent or another chemical operative to clean, disinfect or unclog configured to reside in the internal housing (22); and a pipe (4) in fluid communication with the second end through which the water passes to clean, disinfect and unclog the plumbing outlet.

11. The device according to claim 10, wherein the bar (5) possesses one or more through holes (51) that allow the passage of the water through them.

12. The device according to claim 10, wherein the pipe (4) has a round or rectangular cross-section.

13. The device according to claim 10, wherein an end (41) of the pipe (4) is blind but incorporates radial side holes (43).

14. The device according to claim 10, wherein the cylindrical body (2) incorporates an aerator filter (6).

15. The device according to claim 10, wherein the cylindrical body (2) has threads configured to be fixed to threads on the tap of pressurized fluid outlet (3), and comprises two independent parts, also couplable to each other by means of a thread, one upper (2*a*) with an aerator filter (6), that can be left permanently fixed at the outlet of the tap (3), and a lower (2*b*) with the diameter reducer (21).

16. The device according to claim 10, wherein the cylindrical body (2) is coupled with the tap of the outlet (3) with a sealing O-ring (7).

17. The device according to claim 10, further comprising a dome with an upper hole (81) configured to receive the pipe (4) therethrough.

18. The device according to the claim 17, wherein the dome is transparent.

* * * * *